United States Patent [19]

Miguel

[11] 4,134,386

[45] Jan. 16, 1979

[54] STOVE SWITCH COVER LOCK

[76] Inventor: Fred Miguel, 300 E 150 St., Apt. #1, Bronx, N.Y. 10451

[21] Appl. No.: 822,524

[22] Filed: Aug. 8, 1977

[51] Int. Cl.[2] ..... F24C 3/12

[52] U.S. Cl. ..... 126/42

[58] Field of Search ..... 126/42, 211, 214, 214 A; 70/178; 431/153

[56] References Cited

U.S. PATENT DOCUMENTS

| | | | |
|---|---|---|---|
| 1,329,490 | 2/1920 | Worthington | 126/42 |
| 2,413,237 | 12/1946 | Jones | 126/42 |
| 2,472,793 | 6/1949 | Conterno | 126/42 |
| 2,834,335 | 5/1958 | Rondello | 126/42 |
| 3,043,289 | 7/1962 | Fox | 126/42 |
| 3,527,200 | 9/1970 | Baltz et al. | 126/42 |

*Primary Examiner*—Edward G. Favors

[57] ABSTRACT

A cover for preventing accidental movement of a plurality of controls extending in a row out of a control panel of a stove. The cover comprising a lock adapted to be mounted on the control panel and having a rotatable latch extending behind the control panel, with an elongated housing having a length in excess of the distance between the endmost controls of the row and including top and bottom walls, a front wall, and end walls. The rear of the housing being open to receive the controls therein with the rear edges of the bottom walls and the end walls lying in substantially a common plane. Mounting means is operatively associated with the top wall of the housing for hingeably removably securing the housing to the control panel of the stove for pivotal movement between a closed position in which the cover fully encloses the controls to an open position in which access to the controls is obtainable. A locking element is mounted on the bottom wall and extending forwardly of the rear edge, with the locking element including a slot extending transversely within the locking element, and the locking element adapted to be received within an aperture on the control panel adjacent the lock in the closed position of the cover. The latch extending within the slot in the locked position of the lock, such that the housing is retained in the closed position until the lock is opened and the housing may be pivoted upwardly or removed from the stove.

10 Claims, 5 Drawing Figures

FIG.1
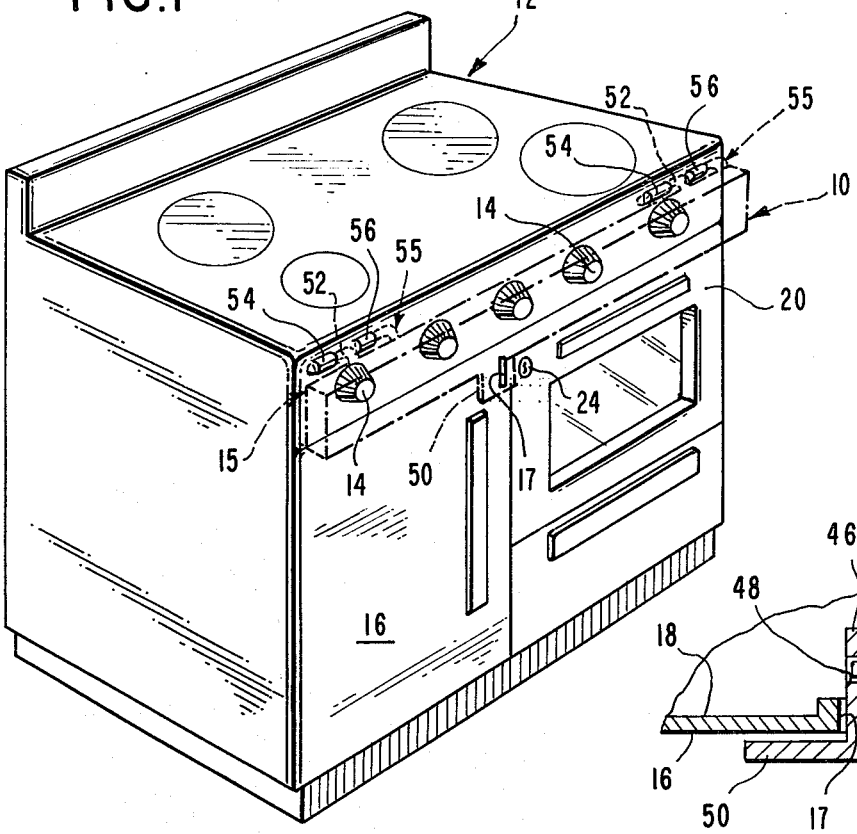
FIG.5
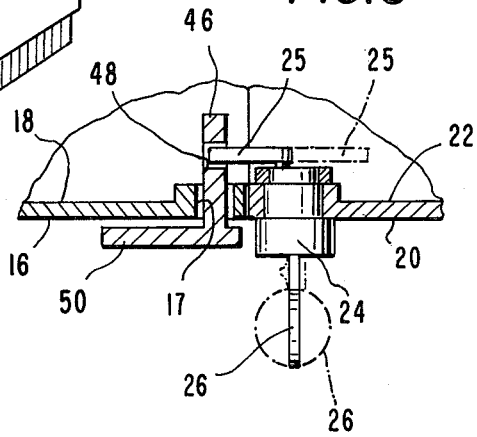
FIG.2
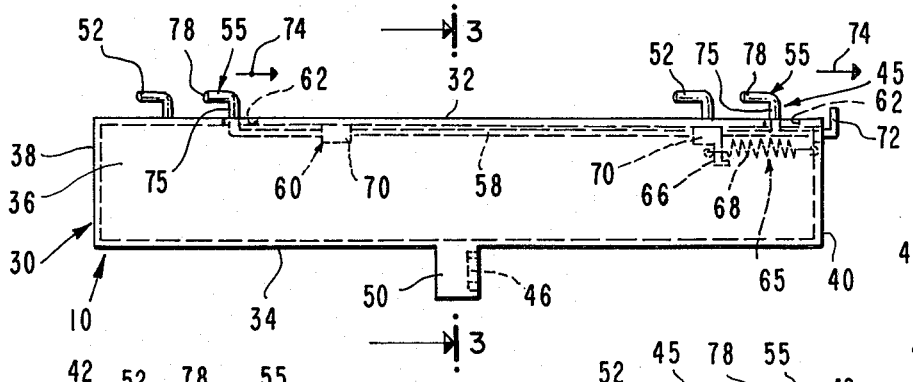
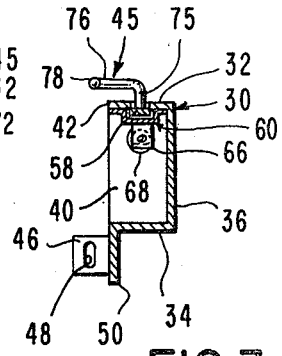
FIG.3
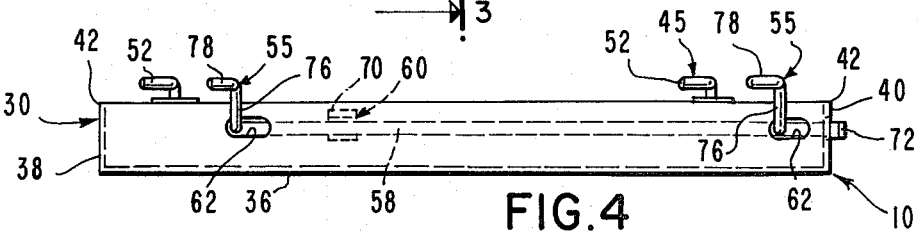
FIG.4

STOVE SWITCH COVER LOCK

BACKGROUND OF THE INVENTION

1. Field of the Invention

The present invention relates to a cover which is utilized as a protective guard over the control knobs of a gas or electric stove.

The hazards of children opening the valves on a stove are well known and appreciated. The controls on a stove are generally accessible to children and inadvertent or playful turning on of unlit gas jets with the consequent hazards associated therewith are prevented by use of the present invention.

2. Description of the Prior Art

Attempts have been made to overcome the above stated problem by providing a cover assembly to enclose control knobs on stoves. These attempts are best illustrated by reference to U.S. Pat. Nos. 2,667,864; 3,043,289; 3,527,200; and 3,789,823. I have found that the solutions set forth in the above referenced patents are unsatisfactory in that they are either too cumbersome to produce, or inadequately provide a solution that is satisfactory. The advantages and distinctions of my invention over the prior art will become more clearly evident as the disclosure proceeds.

OBJECTS OF THE INVENTION

An object of the present invention is to provide a safety cover to enclose the On and Off controls on the stove.

Another object of the present invention is to provide a safety cover to enclose the controls of a stove or range to make them inaccessible to small children, and which cover is easily unlocked to gain access to the control panel, or removal of the cover.

Other objects and advantages of the present invention will become apparent as the disclosure proceeds.

SUMMARY OF THE INVENTION

A cover for preventing accidental movement of a plurality of controls extending in a row out of a control panel of a stove. The cover comprising a lock adapted to be mounted on the control panel and having a rotatable latch extending behind the control panel, with an elongated housing having a length in excess of the distance between the endmost controls of the row and including top and bottom walls, a front wall, and end walls. The rear of the housing being open to receive the controls therein with the rear edges of the bottom walls and the end walls lying in substantially a common plane.

Mounting means is operatively associated with the top wall of the housing for hingeably removably securing the housing to the control panel of the stove for pivotal movement between a closed position in which the cover fully encloses the controls to an open position in which access to the controls is obtainable.

A locking element is mounted on the bottom wall and extending forwardly of the rear edge, with the locking element including a slot extending transversely within the locking element, and the locking element adapted to be received within an aperture on the control panel adjacent the lock in the closed position of the cover. The latch extending within the slot in the locked position of the lock, such that the housing is retained in the closed position until the lock is opened and the housing may be pivoted upwardly or removed from the stove.

The mounting means includes a first pair of hinge pins connected to the housing in fixed spaced relationship to each other above the top wall. The first pair of hinge pins extending in a horizontal plane and adapted to be removably coupled to the control panel. A second pair of hinge pins are mounted relative to the housing in fixed spaced relationship to each other and in longitudinal alignment with the first pair of the hinge pins. The second pair of hinge pins are adapted to be reciprocated between an extended position and a retracted position. The second pair of hinge pins being coupled to the control panel in the extended position, and also removably securable to the control panel in the extended position and releasable from the control panel in the retracted position.

BRIEF DESCRIPTION OF THE DRAWINGS

Although the characteristic features of this invention will be particularly pointed out in the claims, the invention itself, and the manner in which it may be made and used, may be better understood by referring to the following description taken in connection with the accompanying drawings forming a part hereof, wherein like reference numerals refer to like parts throughout the several views and in which:

FIG. 1 is a perspective view of a stove having mounted thereon the cover of the present invention;

FIG. 2 is a front plan view of the cover of the present invention;

FIG. 3 is a side view in section taken along lines 3—3 of FIG. 2;

FIG. 4 is a top plan view of the cover illustrated in FIG. 1; and

FIG. 5 is an enlarged fragmentary view of the lock as mounted relative to the stove.

DETAILED DESCRIPTION OF THE DRAWINGS

Referring to the drawings, there is illustrated in FIGS. 1 through 5 a cover 10 for preventing accidental movement on a stove 12 of a plurality of controls 14 extending in a row out of a control panel 15 of the stove 12. The control panel 15 may extend vertically with the controls 14 extending in a horizontal row. The control panel may include a left section 16 having an inner wall 18, and a right section 20 having an inner wall 22. The sections 16 and 18 may be movable relative to each other as is well known in a conventional stove 12.

The cover 10 may comprise a lock 24 adapted to be mounted on the right section 20 of the control panel 15 and having a rotatable latch 25 extending behind the inner wall 22 of the right section 20 of the control panel 15. A removable key 26 may be utilized with the lock 24. The key 26 may be removed when the cover 10 is locked in place to prevent accidental turning of the knobs or controls 14. The left section 16 may contain an aperture 17 therein adjacent to the lock 24.

An elongated housing 30 is provided having a length in excess of the distance between the endmost controls 14 of the row and including a top wall 32 and bottom wall 34, as well as a front wall 36 and end walls 38 and 40. The rear of the housing 30 being open, with the rear edges 42 of the top and bottom walls 32 and 34, respectively, and the end walls 38 and 40, respectively, lying in substantially a common plane.

Mounting means 45 is operatively associated with the top wall 32 of the housing 30 for hingeably removably securing the housing 30 to the control panel 15 of the stove 12 for pivotal movement between a closed position in which the cover 10 fully encloses the controls 14 to an open position in which access to the controls 14 is obtainable.

A locking element 46 is mounted on the bottom wall 34 and extending forwardly of the rear edge 42, with the locking element including a slot 48 extending transversely within the locking element 46. The locking element 46 is adapted to be received within the aperture 20 on the control panel 15 adjacent the lock 24 in the closed position of the cover 30. The latch 25 extending within the slot 48 in the locked position of the lock 24, such that the housing 30 is retained in the closed position until the lock 24 is opened and the housing 30 may be pivoted upwardly or removed from the stove 12 as hereinafter described. The locking element 46 includes a face plate 50 in front thereof.

The mounting means 45 includes a first pair of hinge pins 52 connected to the housing 30 in fixed spaced relationship to each other above the top wall 36. The first pair of hinge pins 52 extending in a horizontal plane and adapted to be removably coupled to the control panel 15. The control panel 15 includes a pair of first support members 54 provided with first receiving openings (not shown), in axial alignment with each other for receiving the respective first hinge pins 52 in sliding engagement therewith.

A second pair of hinge pins 55 are mounted relative to the housing 30 in fixed spaced relationship to each other and in longitudinal alignment with the first pair of hinge pins 52. The second pair of hinge pins 55 are adapted to be reciprocated between an extended position and a retracted position. The second pair of hinge pins 55 being coupled to the control panel 15 in the extended position thereof. The second pair of hinge pins 55 being removably securable to the control panel 15 in the extended position and releasable from the control panel 15 in the retracted position.

The control panel 15 includes a pair of second support members 56 provided with second receiving openings (not shown), in axial alignment with each other for receiving the respective second hinge pins 55 in sliding engagement therewith. The first and second receiving openings being in axial alignment with each other.

The second pair of hinge pins 55 each include an elongated base 58, with supporting means 60 operatively associated with the top wall 32 for maintaining the base 58 in sliding relationship with respect thereto. A pair of grooves 62 extend through the top wall 32. The grooves 62 extend in substantially parallel spaced relationship to the rear edge 42 of the top wall 32.

The second pair of hinge pins 55 connected at one end thereof to the base 58 and each one of the second pair of pins 55 adapted to extend through one of the grooves 62 above the top wall 32. Resilient means 65 is operatively associated with the housing 30 for urging the base 58 into the extended position. The resilient means 65 may include a flange or bracket 66 extending downwardly from the inner base 58. A spring 68 may be mounted between the flange 66 and the housing 30, as by the end wall 40. The spring 68 applying a force against the flange 66 for urging the mounting means 45 into the extended position, as illustrated in FIGS. 2 and 4. To facilitate movement of the base 58, a pair of clips 70 forms part of the supporting means 60, and are mounted in spaced relationship to each other from the top wall 32. The clips 70 permit the sliding movement of the base 58 relative thereto.

A control lever 72 is provided beyond the end wall 40 with one end thereof joined to the base 58. The opposite free end extending outwardly of the housing 30 for engagement by the user. The free end being pulled outwardly in the direction of arrows 74 effectuates a sliding of the base 58 for retracting the second pair of hinge pins 55 from within their seated position in the second support members 56. During this movement spring 68 is compressed and when the lever 72 is released the second hinge pins 55 will return to their extended position. Initially the stationary pins 52 may be placed in position within the first support members 56. Thereafter, the second hinge pins 55 will be forced within the second support members 56 by the resilient means 65.

Each of the second hinge pins 55 may include a section 75 extending vertically through one of the grooves 62 and connected to the base 58 at one end thereof. A section 76 extends forwardly of the rear edge 42 of the top wall 32, and having one end connected to the other end of the vertically extending section 75. A hinge section 78 is connected to the other end of the forwardly extending section 76 and in axial alignment with the first pair of hinge pins 52, such that the first hinge pins 52 may be positioned within the first receiving openings and the second hinge pins 55 received in the second receiving openings.

Accordingly, the utilization of the lock 24 may lock sections 16 and 20 together, as well as the housing 30 in place. The key 26 may then be removed to permanently safeguard that the controls 14 are not tampered with. When desired the housing 30 may be completely removed from the control panel 15 by unlocking the lock 24 and moving the second pair of hinge pins 55 in the direction of arrows 74 by means of lever 72. If desired, the first hinge pins 52 may then be removed from their mountings by lateral movement of the housing 30.

Although an illustrative embodiment of the invention has been described in detail herein with reference to the accompanying drawings, it is to be understood that the invention is not limited to the precise embodiment and that various changes and modifications may be effected therein without departing from the scope or spirit of the invention.

I claim:

1. A cover for preventing accidental movement of a plurality of controls extending in a row out of a control panel of a stove, said cover comprising:

a. a lock adapted to be mounted on said control panel and having a rotatable latch extending behind said control panel, b. an elongated housing having a length in excess of the distance between the endmost controls of said row and including top and bottom walls, a front wall, and end walls, said housing being open, the rear edges of said top and bottom walls and said end walls lying in substantially a common plane, c. mounting means operatively associated with said top wall of said housing for hingeably removably securing said housing to said control panel of said stove for pivotal movement between a closed position in which said cover fully encloses said controls to an open position in which access to said controls is obtainable, d. a locking element mounted on said bottom wall and extending forwardly of said rear edge, said locking element including a slot extending transversely within said locking element, and e. said locking element adapted to be received within an aperture on said control panel adjacent said lock in the closed position of said cover, and said latch extending within said slot in the locked position of said lock, such that said housing is retained in said closed position until said lock is opened and said housing may be pivoted upwardly or removed from the stove.

2. A cover as in claim 1, wherein said mounting means includes:

a. a first pair of hinge pins connected to said housing in fixed spaced relationship to each other above said top wall, said first pair of hinge pins extending in a horizontal plane, said first pair of hinge pins adapted to be removably coupled to said control panel, b. a second pair of hinge pins mounted relative to said housing in fixed spaced relationship to each other and in longitudinal alignment with said first pair of said hinge pins, said second pair of said hinge pins adapted to be reciprocated between an extended position and a retracted position, said second pair of hinge pins being coupled to said control panel in said extended position, and c. said second pair of hinge pins being removably securable to said control panel in said extended position and releasable from said control panel in said retracted position.

3. A cover as in claim 2, and wherein said second pair of hinge pins further includes:

a. an elongated base, b. supporting means operatively associated with said top wall for maintaining said base in sliding relationship with respect thereto, c. a pair of grooves extending through said top wall, d. said second pair of hinge pins connected at one end thereof to said base and each one of said second pair of pins adapted to extend through one of said grooves above said top wall, and e. resilient means operatively associated with said housing for urging said base into said extended position.

4. A cover as in claim 3, and further including a control lever having one end joined to said bar and the opposite free end extending outwardly of said housing for engagement by the user, said free end being pulled outwardly from said housing for effecting sliding of said base for retracting said second pair of hinge pins.

5. A cover as in claim 3, wherein each said second hinge pin includes:

a. a section extending vertically through one of said grooves and connected to said base at one end thereof, b. a section extending forwardly of said rear edge of said top wall, and having one end connected to the other end of said vertically extending section, and c. a hinge section connected to the other end of said forwardly extending section and in axial alignment with said first pair of hinge pins, such that said first hinge pins may be positioned within first receiving openings and said second hinge pins received in second receiving openings.

6. A cover as in claim 3, and further including:

a. a flange extending downwardly from said base, and b. said resilient means includes a spring mounted between said flange and said housing for applying a force against said flange for urging said mounting means into said extended position.

7. A cover as in claim 3, wherein said supporting means includes a pair of clips mounted on said top wall within said housing for permitting sliding movement of said base relative thereto.

8. A cover as in claim 3, wherein said grooves extend in substantially parallel spaced relationship to said rear edge of said top wall.

9. A cover as in claim 1, wherein said lock includes a removable key to prevent removal of said housing in the locked position.

10. A cover as in claim 1, wherein said locking element includes a face plate extending in front thereof.

* * * * *